United States Patent [19]

Dorler et al.

[11] 4,383,216

[45] May 10, 1983

[54] AC MEASUREMENT MEANS FOR USE WITH POWER CONTROL MEANS FOR ELIMINATING CIRCUIT TO CIRCUIT DELAY DIFFERENCES

[75] Inventors: Jack A. Dorler, Wappingers Falls, N.Y.; Michael O. Jenkins, San Jose, Calif.; Joseph M. Mosley, Hopewell Junction; Stephen D. Weitzel, Poughkeepsie, both of N.Y.

[73] Assignee: International Business Machines Corporation, Armonk, N.Y.

[21] Appl. No.: 229,417

[22] Filed: Jan. 29, 1981

[51] Int. Cl.[3] ..... G05F 1/46

[52] U.S. Cl. ..... 323/282; 307/296 R

[58] Field of Search ..... 307/296 R, 296 A, 511, 307/516; 323/282

[56] References Cited

U.S. PATENT DOCUMENTS

| | | | |
|---|---|---|---|
| Re. 29,619 | 4/1978 | Pastoriza | 340/347 |
| 3,602,799 | 8/1971 | Guillen | 323/4 |
| 3,736,477 | 5/1973 | Berger et al. | 317/235 |
| 3,743,850 | 7/1973 | Davis | 387/32 |
| 3,754,181 | 8/1973 | Kreitz et al. | 323/1 |
| 3,758,791 | 9/1973 | Taniguchi et al. | 307/215 |
| 3,778,646 | 12/1973 | Masaki | 307/215 |
| 3,794,861 | 2/1974 | Bernacchi | 307/297 |
| 3,803,471 | 4/1974 | Price et al. | 318/341 |
| 3,808,468 | 4/1974 | Ludlow et al. | 307/304 |
| 3,978,473 | 8/1976 | Pastoriza | 340/347 |
| 4,004,164 | 1/1977 | Cranford, Jr. et al. | 307/297 |
| 4,029,974 | 6/1977 | Brokaw | 307/296 |
| 4,100,431 | 7/1978 | Stipanuk | 307/213 |
| 4,145,621 | 3/1979 | Colaco | 307/215 |
| 4,160,934 | 7/1979 | Kirsch | 315/307 |
| 4,172,992 | 10/1979 | Culmer et al. | 323/4 |
| 4,287,437 | 9/1981 | Brosch et al. . | |

OTHER PUBLICATIONS

IBM TDB, "Current Source Generator", by G. Keller et al., vol. 12, No. 11, Apr. 1970, p. 2031.

"Precision Integrated Current Source", by A. Cabiedes et al., vol. 13, No. 6, Nov. 1970, p. 1699, (IBM TDB).

"Adjustable Underfrequency–Overfrequency Limiting Circuit", by W. B. Nunnery, vol. 15, No. 6, Nov. 1972, pp. 1927–1929, (IBM Technical Disclosure Bulletin).

IBM TDB, "Voltage Reference Buffer", by J. A. Dorler et al., vol. 14, No. 7, Dec. 1971, p. 2095.

"Reference Voltage Generator and OFF–Chip Driver for Current Switch Circuit", by A. Brunin, vol. 21, No. 1, Jun. 1978, pp. 219–220, (IBM TDB).

"Gated Current Source", by J. W. Spencer, Jr., vol. 21, No. 7, Dec. 1978, pp. 2719–2720, (IBM TDB).

"Integrated Injection Logic Shaping Up as Strong Bipolar Challenge to MOS", Electronic Design 6, Mar. 15, 1974, pp. 28 and 30.

"$I^2L$ Puts It All Together for 10-bit A–D Converter Chip", by Paul Brokaw, Electronics, Apr. 13, 1978, pp. 99–105.

IBM Technical Disclosure Bulliten, "Chip Performance Regulator Using On–Chip Voltage Controlled Oscillator", K. R. King, vol. 23, No. 2A, Dec. 1980, pp. 2631–2632.

"Delay Regulation A Performance Concept", F. Berndlmaier et al., Proceedings IEEE International Conference on Circuits and Computers, ICCC80, vol. 2 of 2, Oct. 1980.

*Primary Examiner*—William M. Shoop

*Attorney, Agent, or Firm*—Wesley DeBruin

[57] ABSTRACT

An on chip delay regulator circuit which varies the power in logic or array circuits on the chip so as to minimize, or eliminate, chip to chip circuit speed differences caused by power supply variations and/or lot to lot process differences, temperature, etc. The on chip delay regulator accomplishes this by comparing a periodic reference signal to a periodic on chip generated signal which is sensitive to power supply changes, lot to lot process changes, temperature, etc. The comparison creates an error signal which is used to change the power (current or voltage) supplied to the on chip circuits. By changing the circuit power, the circuit speed (gate delay) is increased or decreased as necessary to maintain a relatively constant circuit speed on each chip. For example, a plurality of integrated circuit chips each contain an on chip delay regulator. The on chip delay regulator on each chip of said plurality of integrated circuit chips receives and responds to the same signal (or clock). Each chip provides a discrete on chip generated signal related to the parameters of the chip. The gate delay (or speed) of the circuitry on each chip is determined by its on chip delay regulator under control of the common reference signal (or clock). At least certain of the chips include an AC measurement circuit for comparing the periodicity of said reference signal with the periodicity of said on generated chip signal and cooperating with the delay regulator thereof to provide one of three discrete electrical manifestations.

11 Claims, 23 Drawing Figures

REFERENCE GENERATOR

LOW PASS FILTER $V_{CO}$ (RLF)

TYPICAL GATE

BUFFER (POWER AMPLIFIER)

LEVEL SHIFT

INTERNAL GATE

AC MEASUREMENT MEANS FOR USE WITH POWER CONTROL MEANS FOR ELIMINATING CIRCUIT TO CIRCUIT DELAY DIFFERENCES

FIELD OF THE INVENTION

A circuit which varies the power in logic or array circuits so as to minimize, or eliminate, chip to chip circuit speed differences caused by variations of power supply, lot to lot process differences, temperature, etc.

This is accomplished by comparing a reference signal to an on chip generated signal which is sensitive to power supply, lot to lot process changes, temperature, etc. The comparison creates an error signal which is used to change the power (current or voltage) supplied to the on chip circuits. By changing the circuit power, the circuit speed is increased or decreased as necessary to maintain a constant speed. Additionally, the time relationship between the reference signal and the on chip generated signal may be monitored to provide a manifestation representative of the gate delay (or speed) capability of the chip. (Reference is made to U.S. patent application Ser. No. 150,762, filed May 16, 1980, fully identified infra.)

CROSS REFERENCE TO RELATED APPLICATIONS

U.S. patent application Ser. No. 98,439 entitled "Method and Circuitry For Equalizing the Differing Delays of Semiconductor Chips", filed Nov. 29, 1979 by R. Brosch et al., granted as U.S. Pat. No. 4,287,437 on Sept. 1, 1981 and of common assignee herewith.

U.S. patent application Ser. No. 150,762 entitled "Power Control Means for Eliminating Circuit to Circuit Delay Differences and Providing a Desired Circuit Delay", filed May 16, 1980 by E. Berndlmaier, J. A. Dorler, J. M. Mosley and S. D. Weitzel and of common assignee herewith. (See also, publication entitled "Delay Regulation a Performance concept", by E. Berndlmaier, J. A. Dorler, J. M. Mosley and S. D. Weitzel, Proceedings of the IEEE International Conference on Circuits and Computers, ICCC80, Volume 2 of 2, edited by N. B. Guy Rabbat, Oct. 1-3, 1980, Ryetown Hilton Inn, Portchester, New York, IEEE catalog No. 80CH1511-5 Library of Congress Catalog Card No. 79-90696.)

BACKGROUND OF THE INVENTION AND PRIOR ART

The current method of circuit design is to create logic circuits and array circuits which operate at a specific power level. There are numerous teachings in the art of circuits used to maintain a specific power level or specific current level within a logic gate. In particular, current switch technology has additional circuitry on the chip to minimize current level changes within the logic gate while temperature, power supplies, and lot to lot processes vary. FIG. 1 shows a typical logic speed power curve with an arrow showing the current design practice—pick a power level, maintain the power level and accept the resulting circuit speed (gate delay). The design problem is trying to minimize the performance changes under a variety of conditions. The gate delay versus power curve in FIG. 1 can move in any direction and even change slope. At the same time, the power regulating circuitry has its own perturbations. These result in a wide distribution of logic gate speeds.

FIG. 2 shows a gate delay versus power curve used to illustrate the preferred design technique. (Reference is made to U.S. patent application Ser. No. 150,762.) The speed or delay of the logic gate is selected and the power within the circuit is adjusted to achieve this speed. This is accomplished by designing on chip circuitry sensitive to the transient performance characteristics of the on chip logic or array circuits. This special circuitry (delay regulator) will generate a signal indicative of the chip performance (speed vs. power characteristic) to be compared to a system wide periodic reference signal or clock. The comparison creates a signal which controls the power in the logic and/or array circuitry on chip thereby controlling the performance. [Namely, the point on gate delay versus power curve which corresponds to a fixed gate delay]. By connecting the reference signal to all of the chips in the system, all of the chips will have the same relative performance, i.e., gate delay or speed. Since this is a continuous comparison between the reference signal and the on chip signal, many variables affecting performance, such as power supply, temperature changes, chip to chip process variations, etc., will be minimized or eliminated.

With reference to U.S. Patent numbers and publications, a number of prior art disclosures and teachings in the field of integrated circuits are identified below.

Reference is made to U.S. Pat. No. RE. 29,619 entitled "Constant-Current Digital-to-Analog Converter" granted Apr. 25, 1978 to J. J. Pastoriza.

Reference is made to U.S. Pat. No. 3,602,799 entitled "Temperature Stable Constant Current Source" granted Aug. 31, 1971 to F. J. Guillen.

Reference is made to U.S. Pat. No. 3,743,850 entitled "Integrated Current Supply Circuit" granted July 3, 1973 to W. F. Davis.

Reference is made to U.S. Pat. No. 3,754,181 entitled "Monolithic Integrable Constant Current Source For Transistors Connected As Current Stabilizing Elements" granted Aug. 21, 1973 to W. Kreitz et al.

Reference is made to U.S. Pat. No. 3,758,791 entitled "Current Switch Circuit" granted Sept. 11, 1973 to K. Taniguchi et al.

Reference is made to U.S. Pat. No. 3,778,646 entitled "Semiconductor Logic Circuit" granted Dec. 11, 1973 to A. Masaki.

Reference is made to U.S. Pat. No. 3,794,861 entitled "Reference Voltage Generator" granted Feb. 26, 1974 to J. R. Bernacchi.

Reference is made to U.S. Pat. No. 3,803,471 entitled "Variable Time Ratio Control Having Power Switch Which Does Not Require Current Equalizing Means" granted Apr. 9, 1974 to R. G. Price et al.

Reference is made to U.S. Pat. No. 3,808,468 entitled "Bootstrap FET Driven With On-Chip Power Supply" granted Apr. 30, 1974 to P. J. Ludlow et al.

Reference is made to U.S. Pat. No. 3,978,473 entitled "Integrated-Circuit Digital to Analog Converter" granted Aug. 31, 1976 to J. J. Pastoriza.

Reference is made to U.S. Pat. No. 4,004,164 entitled "Compensating Current Source" granted Jan. 18, 1977 to H. C. Cranford, Jr., et al.

Reference is made to U.S. Pat. No. 4,029,974 entitled "Apparatus for Generating A Current Varying With Temperature" granted June 14, 1977 to A. P. Brokaw.

Reference is made to U.S. Pat. No. 4,100,431 entitled "Integrated Injection Logic to Linear High Impedance Current Interface" granted July 11, 1978 to J. J. Stipanuk.

Reference is made to U.S. Pat. No. 4,145,621 entitled "Transistor Logic Circuits" granted Mar. 20, 1979 to S. F. Colaco.

Reference is made to U.S. Pat. No. 4,160,934 entitled "Current Control Circuit For Light Emitting Diode" granted July 10, 1979 to H. C. Kirsch.

Reference is made to U.S. Pat. No. 4,172,992 entitled "Constant Current Control Circuit" granted Oct. 30, 1979 to D. D. Culmer et al.

Reference is made to U.S. Pat. No. 3,736,477 entitled "Monolithic Semiconductor Circuit For A Logic Circuit Concept of High Packing Density" granted May 29, 1973 to H. H. Berger et al. The Berger et al. patent discloses basic $I^2L$ structure and circuitry.

Reference is made to the following IBM technical Disclosure Bulletin Publications:

(1) "Current Source Generator" by G. Keller et al., Vol. 12, No. 11, April 1970, page 2031;

(2) "Precision Integrated Current Source" by A. Cabiedes et al., Vol. 13, No. 6, November 1970, page 1699;

(3) "Voltage Reference Buffer" by J. A. Dorler et al., Vol. 14, No. 7, December 1971, page 2095;

(4) "Adjustable Underfrequency-Overfrequency Limiting Circuit" by W. B. Nunnery, Vol. 15, No. 6, November 1972, pages 1927–9;

(5) "Reference Voltage Generator and OFF-Chip Driver For Current Switch Circuit" by A. Brunin, Vol. 21, No. 1, June 1978, pages 219–20; and (6) "Gated Current Source" by J. W. Spencer, Jr., Vol. 21, No. 7, December 1978, pages 2719–20.

Reference is also made to the following publications:

(1) "Integrated Injection Logic Shaping Up As Strong Bipolar Challenge to MOS", Electronic Design 6, Mar. 15, 1974, pages 28 and 30.

(2) "$I^2L$ Puts It All Together For 10-bit A-D Converter Chip" by Paul Brokaw, Electronics, Apr. 13, 1978, pages 99–105.

(3) "Delay Regulation A Performance Concept", by E. Berndlmaier, J. A. Dorler, J. M. Mosley and S. D. Weitzel, Proceedings of the IEEE International Conference on Circuits and Computers, ICCC80, Volume 2 of 2, edited by N. B. Guy Rabbat, Oct. 1–3, 1980, Rye Town Hilton Inn, Portchester, New York, IEEE Catalog No. 80CH1511–5, Library of Congress Catalog Card No. 79–90696.

SUMMARY OF THE INVENTION

The invention disclosed and claimed in U.S. patent application Ser. No. 150,762 (fully identified supra) may be summarized as an electronic system including one or more integrated circuit chips, each of said one or more integrated circuit chips having a plurality of interconnected logic and/or array circuits thereon, each of said logic and/or array circuits having a gate delay versus power curve, said system being characterized by the inclusion of power control means for regulating the power to each of said one or more chips whereby the power provided to said logic circuits on said chips may vary chip to chip but said gate delay of said logic circuits on each of said chips will be essentially equal one to another.

The invention disclosed and claimed in U.S. patent application Ser. No. 150,762, may also be summarized as a system including N interconnected integrated circuit chips, where N is an integer positive number, each of said N interconnected integrated circuit chips containing a delay regulator means and at least first, second and third interconnect logic circuits, said logic circuits on each of said chips having a relatively unique speed/power characteristic; a source of periodic clock pulses, said delay regulator means of each of said N interconnected circuit chips being adapted to receive said period clock pulses, each of said delay regulator means including active circuit means for generating an electrical manifestation related to said periodicity of said periodic clock pulses and said speed/power characteristic of the logic circuits on the chip on which it is contained; and connecting means on each of said N interconnected integrated circuit chips, said connection means on each of said N interconnected integrated circuit chips conveying the electrical manifestation generated by the delay regulator means on said chip to said logic circuits on said same chip, whereby the power provided to said logic circuits on said chips may vary chip to chip but said speed of said logic circuits on each of said chips will be essentially equal one to another.

The invention disclosed and claimed in U.S. patent application Ser. No. 150,762, as summarized in the preceding paragraph wherein each of said delay regulator means essentially consists of a phase locked loop.

The invention disclosed and claimed herein may be viewed as an improvement to the invention disclosed and claimed in U.S. patent application Ser. No. 150,762, filed May 16, 1980, entitled "Power Control Means For Eliminating Circuit to Circuit Delay Differences and Providing a Desired Circuit Delay" by E. Berndlmaier, J. A. Dorler, J. M. Mosley and S. D. Weitzel. The improvement may be considered to be the provision and inclusion of circuitry which cooperates with the circuitry of the "phase locked loop" to render a quantified electrical manifestation of the gate delay (or speed) capability of the chip. The practice of the invention readily permits the sorting of chips in categories in accordance with their speed.

BRIEF DESCRIPTION OF THE DRAWINGS

Referring to FIG. 3, it will be recalled that each chip contains a Delay Regulator. The circuit of the Delay Regulator of each chip may be the same. Each of the blocks in FIG. 4 encloses a legend and a figure number. For example, the phase comparator block has the legend "$\phi$ Compare" and "(FIG. 5)", whereas the voltage controlled oscillator includes the legend "VCO (RLF)" and "(FIG. 8)". These legends denote that the logical circuit of the $\phi$ compare circuit is shown in FIG. 5 and the logical circuit of the voltage controlled oscillator is shown in FIG. 8. In the illustrative embodiment of the invention, the Delay Regulator comprises a "$\phi$ compare circuit (FIG. 5)", a "Low Pass Filter (FIG. 6)", a "Buffer Circuit or Power Amplifier Circuit (FIG. 7)", a "Voltage Controlled Oscillator RLF (FIG. 8)", and a "Level Shift Circuit (FIG. 9)" interconnected as shown in FIG. 4. It will be appreciated by persons skilled in the art that a current controlled oscillator may be employed in lieu of the voltage controlled oscillator.

Figure 8:
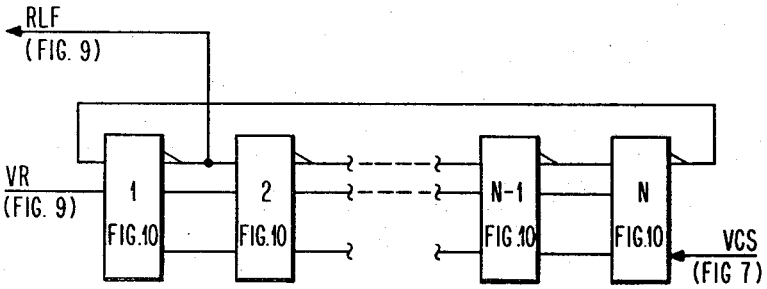
FIG. 8 discloses a Voltage Controlled Oscillator (RLF) which may be employed, in accordance with the invention, in the Delay Regulator (FIG. 4).
Figure 10:
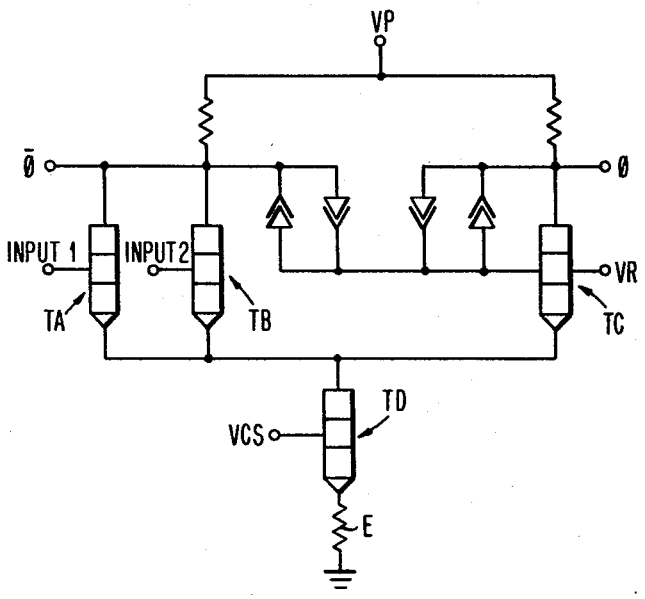

It is to be noted that the Voltage Controlled Oscillator preferably employs a plurality of logic circuits of the type whose gate delay (or speed) is to be regulated by the Delay Regulator. In the illustrative embodiment of the invention disclosed herein, the logic circuit whose gate delay (or speed) is to be controlled is a current switch (or ECL) as shown in FIG. 10. The Voltage Controlled Oscillator may take the form of a recirculating loop frequency (RLF) as shown in FIG. 8 wherein the total number of inversions is odd.

Figure 4:
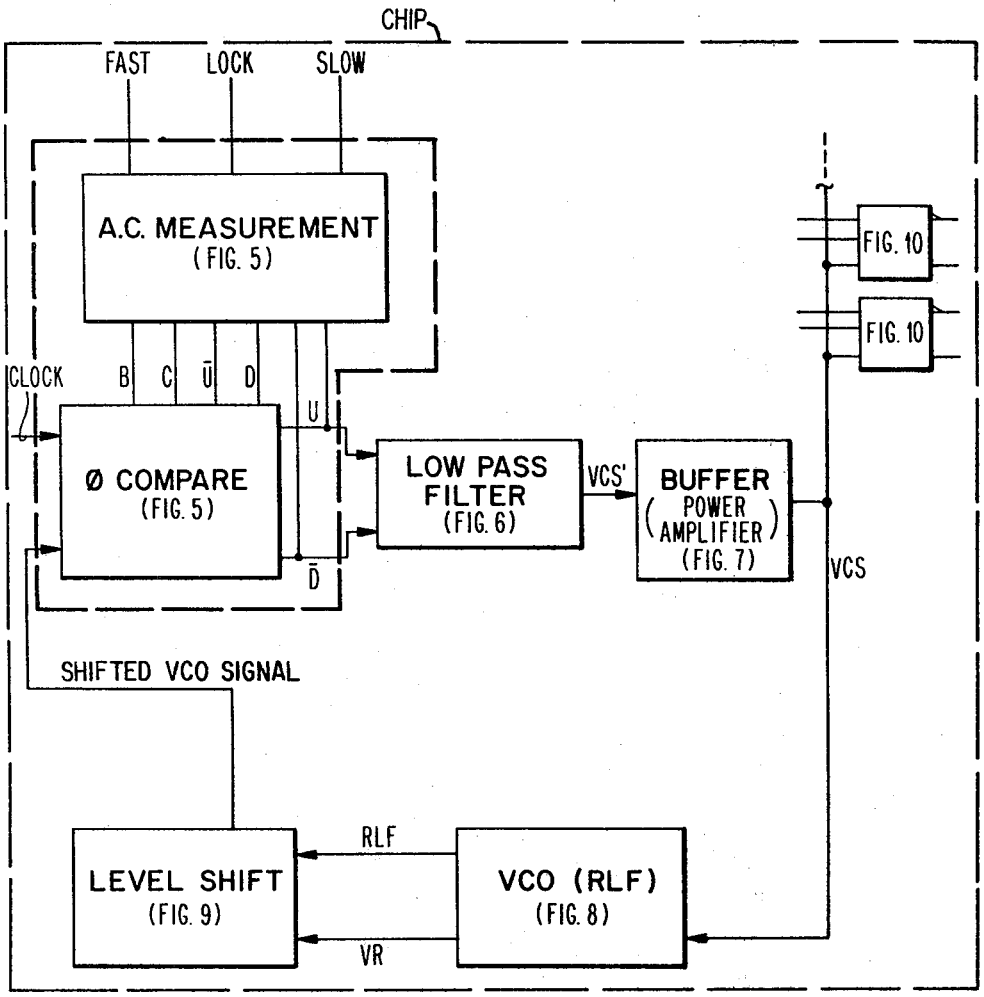
FIG. 4 is a block diagram of a Delay Regulator (Power Control Means) in accordance with the invention.
Figure 9:
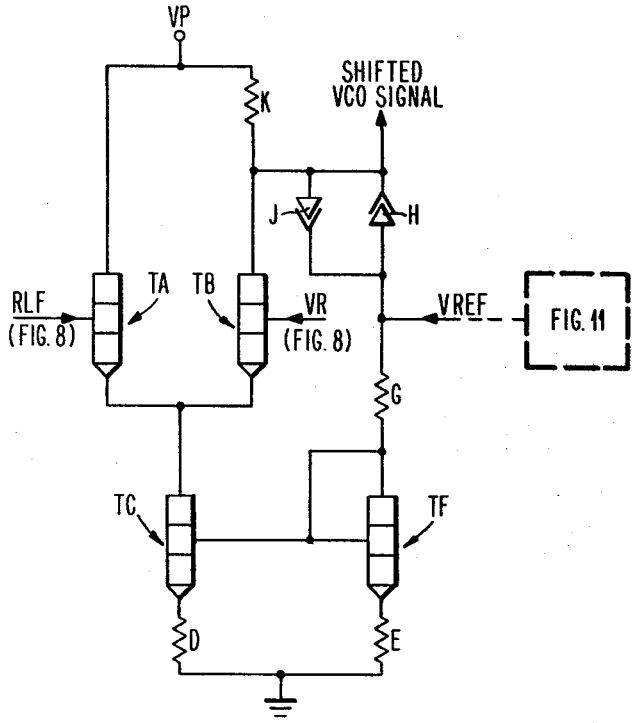

FIG. 9 discloses a Level Shifter circuit which may be employed, in accordance with the invention, in the Delay Regulator (FIG. 4).

FIG. 10 is a representative current switch logic (ECL) circuit whose gate delay (or speed) is regulated, in accordance with the invention, by the Delay Regulator.

Figure 11:
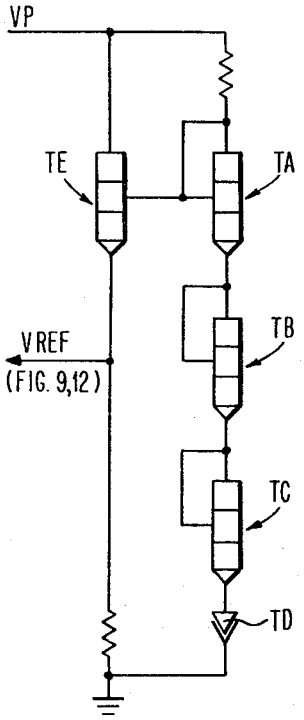
Figure 12:
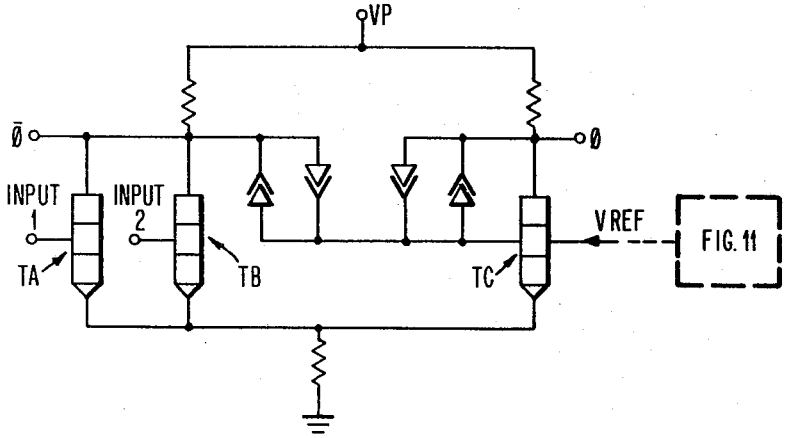

FIG. 11 discloses a reference voltage generator for providing a reference voltage Vref which may be utilized by the level shift circuit of FIG. 9 and the Internal Gate circuit of FIG. 12.

Figure 5:
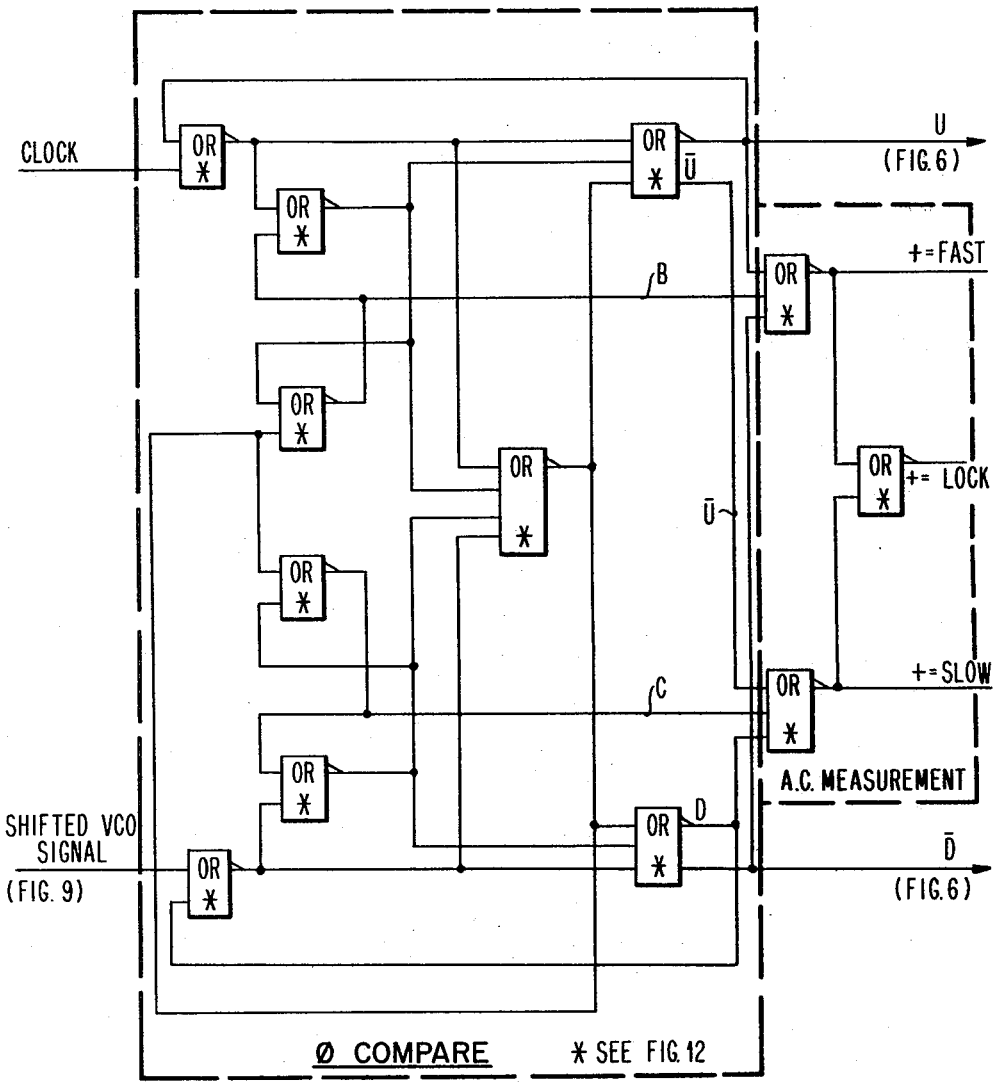
FIG. 5 discloses a logical block diagram of a phase comparator circuit which may be employed, in accordance with the invention, in the Delay Regulator (FIG. 4). [It is to be appreciated that the phase comparator may be logically the equivalent of the commercially available Phase Frequency Detector MC12040 of Motorola MECL Phase-Locked Loop Components]. Also disclosed are three logic gates employed as an AC Measurement Circuit. The input signals to the AC Measurement Circuit are obtained from the $\phi$ comparator circuit and provide the logic signals FAST, SLOW and LOCK.

FIG. 12 discloses an Internal Gate circuit of the current switch (or ECL) circuit family which may be utilized in the phase comparator of FIG. 5.

Figure 13:
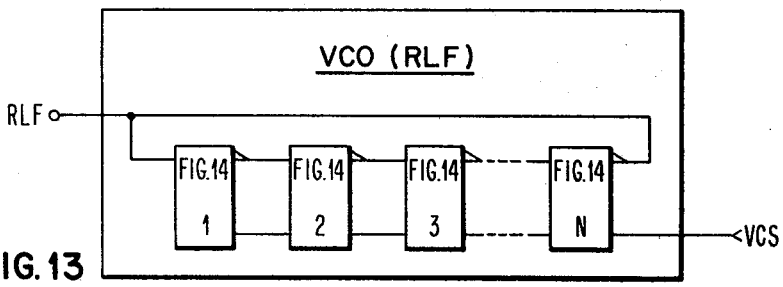
Figure 14:
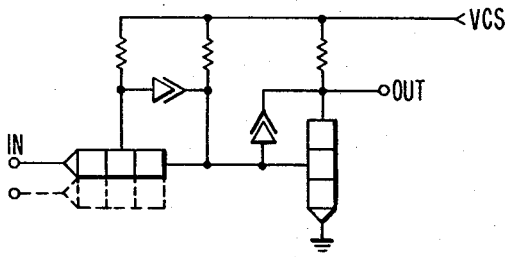

FIG. 13 is a block diagram of a voltage controlled oscillator (VCO-RLF) for use, in accordance with the invention, in the power control means of a system wherein the circuits whose delay is to be regulated or optimized are of the $T^2L$ technological circuit family (such as shown in FIG. 14).

FIG. 14 is a representative, or illustrative, $T^2L$ circuit whose delay, in accordance with the invention, may be regulated, or optimized, by the employment of a power control means including the Voltage Controlled Oscillator (RLF) of FIG. 13.

Figure 15:
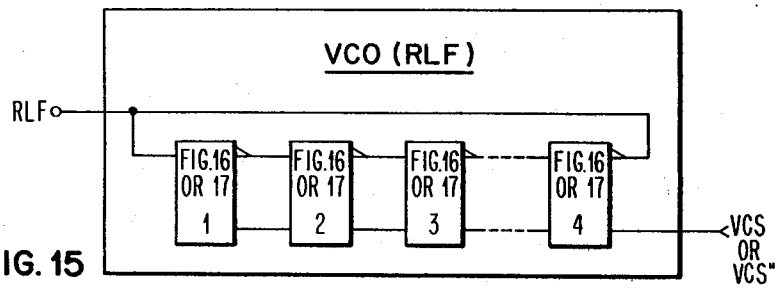
Figure 16:
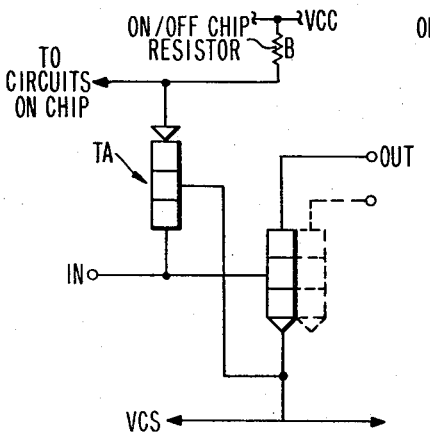
Figure 17:
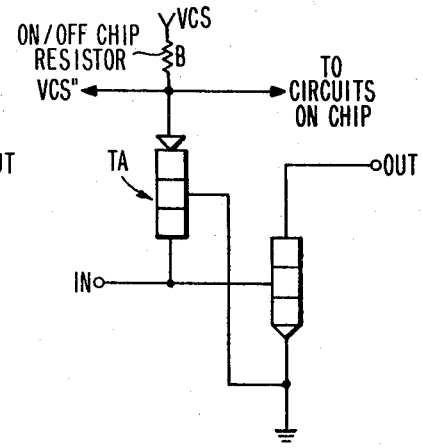

FIG. 15 is a block diagram of a voltage controlled oscillator for use, in accordance with the invention, in the power control means of a system wherein the circuits whose delay is to be regulated, or optimized, are of the $I^2L$ technological circuit family (such as shown in FIG. 16 or FIG. 17).

FIG. 16 is a representative, or illustrative, $I^2L$ circuit whose gate delay, in accordance with the invention, may be regulated, or optimized, by the employment of a power control means including the voltage controlled oscillator of FIG. 15.

FIG. 17 is a second representative or illustrative, $I^2L$ circuit whose gate delay, in accordance with the invention, may be regulated, or optimized, by the employment of a power control means including the voltage controlled oscillator of FIG. 15.

Figure 18:
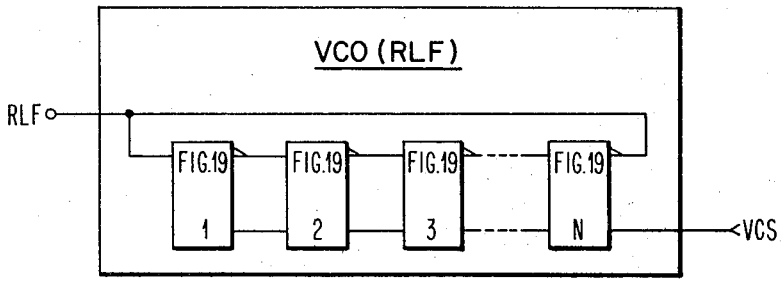
Figure 19:
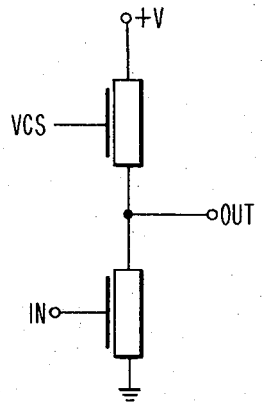

FIG. 18 is a block diagram of a voltage controlled oscillator for use, in accordance with the invention, in the power control means of a system wherein the circuits whose delay is to be regulated, or optimized, are of the FET technological circuit family (such as shown in FIG. 19).

FIG. 19 is a representative, or illustrative, FET circuit whose gate delay, in accordance with the invention, may be regulated, or optimized, by the employment of a power control means including the voltage controlled oscillator of FIG. 18.

DESCRIPTION OF THE PREFERRED EMBODIMENTS

Figure 1:
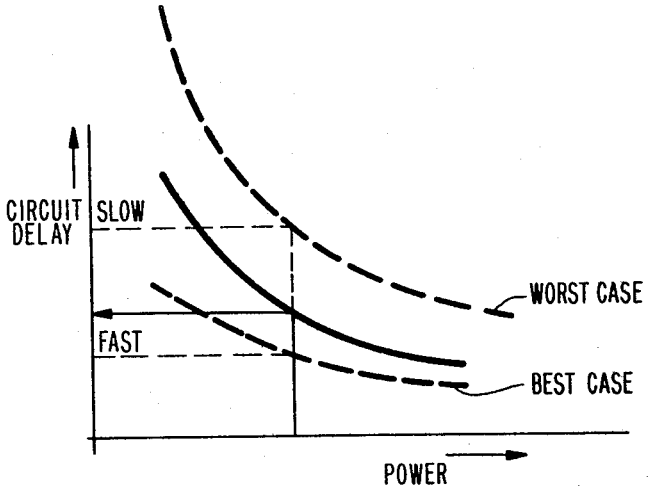
FIG. 1 discloses a gate delay versus power curve for a representative logic circuit. The curve of FIG. 1 depicts the prior art condition wherein the power is fixed, or chosen, and the speed or gated delay of the circuit is in accordance with the power supplied thereto. (Note the arrowhead adjacent the legend "Circuit Delay").

FIG. 1 shows a typical logic gate delay versus power curve which all logic families exhibit. Current practice is to operate a logic gate at a specific power level. This is evidenced by the many disclosures of circuitry designed to maintain a specific power level or current setting in the logic gate circuitry. The idea of trying to maintain the specific power or current setting has several problems. The first problem is related to the manufacturing of semiconductor devices. During the normal course of semiconductor manufacturing, there are minor perturbations to the process. These minor changes effect the position of the speed power curve as shown in FIG. 1. As the curve varies, the gate delay varies. The second problem is the support circuitry that is designed to maintain the specific power or current level in the logic circuit. These circuits are also subject to process changes and at the same time in the system are susceptible to power supply changes and temperature changes. The end result is a logic gate whose power is closely regulated but whose delay can vary considerably.

Figure 2:
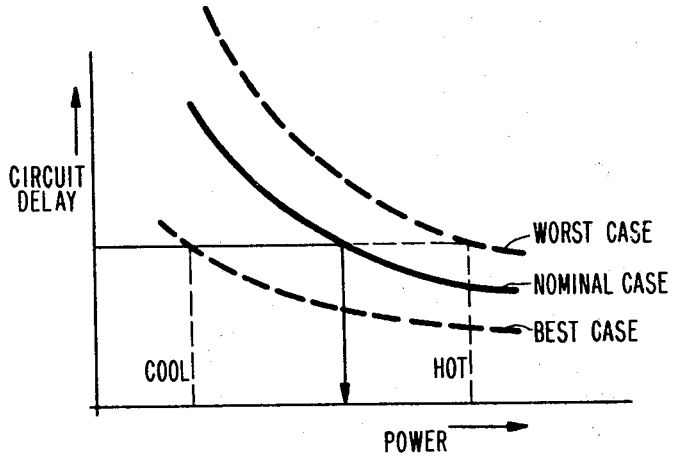
FIG. 2 discloses a gate delay versus power curve for a representative logic circuit. The gate delay (or speed) versus power curve of FIG. 2 is depicted in accordance with the invention wherein the gate delay (or speed) of each of a plurality of logic circuits on a chip (or chips) is fixed, or designed, and the power (current or voltage) supplied to the logic circuits is in accordance with the chosen or fixed speed. (Note the arrowhead adjacent the legend "Power").

FIG. 2 shows the method in accordance with the invention. The gate delay is regulated while the power of the logic gate is permitted to vary so that as the speed power curve changes through process, temperature or power supply, the gate delay remains constant while the power varies.

Figure 3:
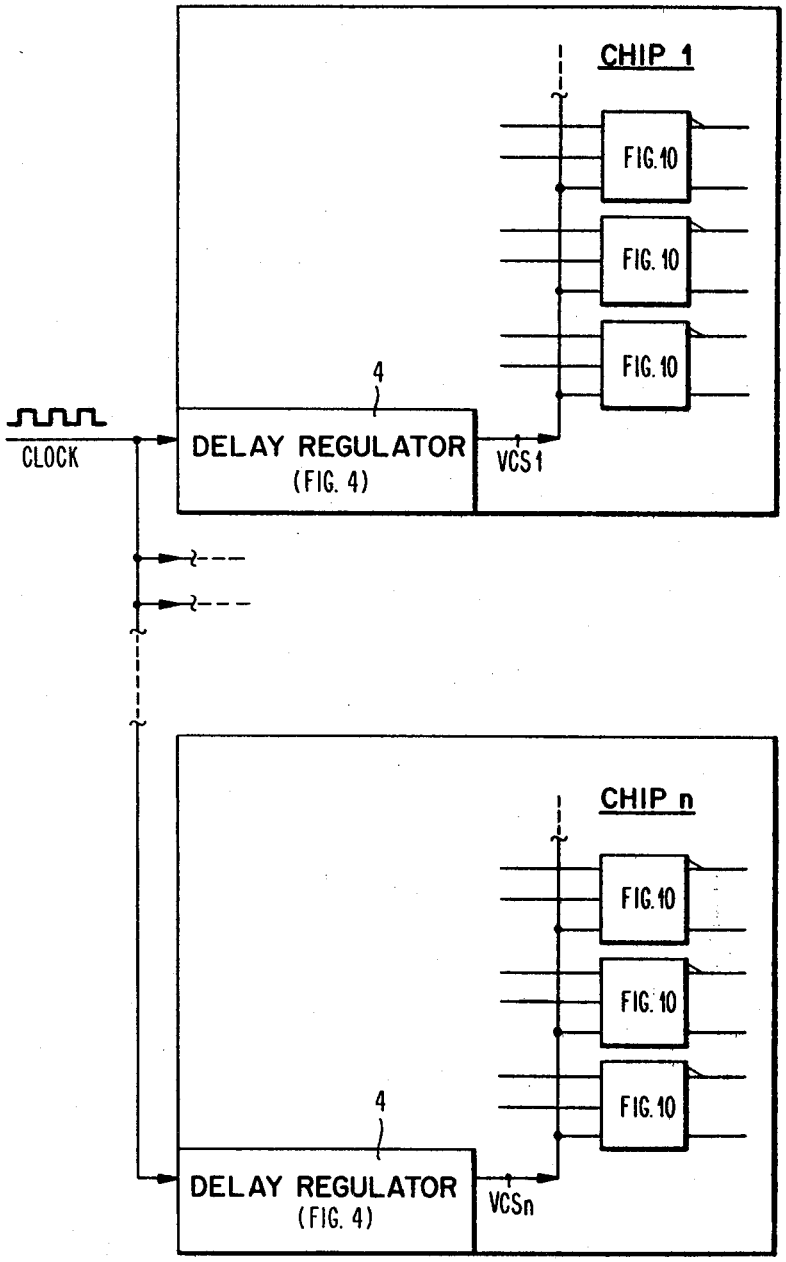
FIG. 3 discloses a block diagram in accordance with the invention. A plurality of integrated circuit chips 1 through N are depicted. Each integrated circuit chip includes a Delay Regulator and a plurality of interconnected logic circuits. In the drawing, only three logic circuits are shown. The logic circuits are respectively represented as blocks enclosing the legend "FIG. 10". Also, since it is not necessary to an understanding of the invention, the interconnections between the logic circuits on each chip and between chips are not shown. It will be appreciated by persons skilled in the art that each of the chips may contain hundreds of interconnected logic circuits. Also, that the invention is not limited to logic circuits of the type (current switch or ECL) shown in FIG. 10. From the detailed description hereinafter, it will be readily apparent to persons of ordinary skill in the art that the invention may be practiced with $T^2L$, DTL, $I^2L$ and other technology families as well as arrays. Still referring to FIG. 3, it will be seen that the Delay Regulator 4 of each chip receives the same clock signal. Each of the Delay Regulators internally generates a discrete distinct on chip reference signal which in co-action with the clock signal causes the Delay Regulator to provide a unique signal VCS (Voltage Current Source). For example, the Delay Regulator of chip 1 (FIG. 3) provides the signal VSC1, whereas chip 2 Delay Regulator provides the signal VCS2 (not shown), and chip N Delay Regulator provides the signal VCSn. Further, magnitudes of the VCS1, VCS2 . . . to VCSn will not necessarily bear any fixed relationship one to another. The magnitude or values of each of the potentials VCS1, VCS2 . . . to VCSn will dictate a point on the gate delay (speed) versus power curve associated with its chip which will provide the desired speed.

FIG. 3 illustrates the implementation of the invention at the system level. The system may consist of N chips, such as shown chips 1 through N. On each chip there will be a delay regulator circuit which will control the power to the remaining logic gates on the chip. In this example, we are using the logic gates shown in FIG. 10 which are the current switch technology. The signal VCS is used to control the power in the logic gate by controlling the current source voltage. The clock signal shown in FIG. 3 goes to the delay regulator circuitry of each of the N chips. This clock signal contains the speed or timing information for the delay regulation circuit. The delay regulator circuit takes this clock signal, compares it to an on chip speed sensing circuit and then adjusts the power within the logic gates on the chip to obtain the same speed as the clock dictates. In this manner, the speed from chip to chip is the same while the power varies chip to chip. Since all the chips in the system will have logic gates with the same speed, the system designer must no longer design for slow chips and fast chips in a specific gate path. All chips will have the same gate delay. It is to be appreciated that the clock signal is preferably the system clock signal. However, it will be evident from the detailed description hereinafter that the clock signal applied to the delay regulator may be other than the system clock.

FIG. 4 shows, in accordance with the invention, an example of an embodiment of delay regulation and AC measurement. The delay regulator circuit consists of the phase compare, the low pass filter, the buffer, the VCO and the level shift circuitry. The phase compare circuitry compares the off-chip clock signal to the shifted VCO signal. The outputs U and $\overline{D}$ create a signal which has a pulse width directly proportional to the phase difference of the input clock signal and shifted VCO signal. This pulse width sensitive signal has a frequency the same as the input clock frequency. The signals U and $\overline{D}$ go to the low pass filter which removes this carrier input clock frequency from the signal. The output VCS' is a DC voltage which is proportional to the pulse width input to the low pass filter. VCS' goes to the buffer circuitry. The buffer circuit is an amplifier with gain of one. It has a high input impedance for the low pass filter signal VCS'. The buffer also has a low output impedance to drive the VCS signal to the other gates on the chip and to the VCO circuitry. The VCS signal controls the power in the logic gates on the chip. In this particular example (see FIG. 10), the signal VCS controls the current in the current source of the logic gate. Increasing VCS increases the power in the circuit whereas decreasing VCS decreases the power in the circuit. The voltage control oscillator produces a signal RLF whose frequency is proportional to the input VCS signal. The VCO circuit should have the same speed power sensitivities as the logic gates on the remaining part of the chip. Thus, as the VCS signal changes the gate delay on the logic gate, it also changes the frequency of the VCO. The output signal RLF is a periodic logic signal. The output VR is the logic threshold about which the RLF signal changes. These two signals go to the level shift circuit which produces an output signal, shifted VCO signal, which has the same logic level as the input clock and at the same frequency as the signal RLF. It can be seen that this arrangement of the phase compare, the low pass filter, the buffer, the VCO and the level shift circuitry creates a phase lock loop. By using this phase lock loop technique, the VCO will tend to lock onto the input clock signals. This phase lock loop action will tend to reject process changes, temperature changes and power supply changes within the ability of the VCO to lock onto the clock. Once the VCO has locked, the remaining logic gates on the chip have had their power changed so that the gate delay now becomes controlled by the input clock frequency signal. It can be seen that the input clock signal, which at the system level goes to all chips, controls the gate delay on each individual chip, regardless of the power the logic gate dissipates or the temperature of the chip or the lot to lot process changes which occur during the manufacturing of the chip.

The phase compare circuitry also generates signals B, C, $\overline{U}$ and D which, when used in conjunction with generated signals U and $\overline{D}$, give an indication as to whether the VCO signal locked onto the clock. This lock indicator is used to determine if the chip can attain the AC performance dictated by the clock. The AC measurement circuit creates three signals—fast, slow and lock. The signal 'fast' indicates the VCO frequency is higher than the clock frequency. The signal 'slow' indicates the VCO frequency is lower than the clock frequency. The signal 'lock' indicates the VCO has locked onto the clock.

It can also be seen that the phase compare, low pass filter, buffer, level shift and AC measurement circuitry need not be on the chip itself. The important circuitry to be on the chip is the VCO (RLF) which senses the speed or gate delay which exists on the chip. These other five logic circuit blocks (FIGS. 5, 6, 7 and 9) can exist off chip on another chip or even be composed of discrete components. The VCO (RLF), however, must exist on the same chip as the logic gates which are to be controlled.

FIG. 5, in accordance with the invention, is a logic diagram of the phase compare circuitry and AC measurement circuit. The circuit, $\phi$ compare circuit, may be a commercially available part number. For example, Motorola part number MC12040 entitled "Phase Frequency Detector" of Motorola's MECL Phase-Lock Loop Components. In the illustrative example, the logic gates are composed of the circuits in FIG. 12. The function of this logic circuit is to compare the phase of the two input signals, the off chip system clock and the shifted VCO signal, and produce a logic signal at the outputs U and $\overline{D}$ which has the same frequency as the input signals and has a pulse width proportional to the phase difference of the two input signals.

The logic gates used in the AC measurement circuit are also composed of the circuits in FIG. 12. The function of this circuit is to determine if the VCO signal is locked onto the clock, or the VCO signal is faster or slower (non-lock) than the clock. This is accomplished by using various timing signals within the phase compare circuitry to determine logically whether a lock or non-lock condition occurs.

It can be seen from FIG. 5 that signal SLOW is generated by the logical NOR of signals U, D and C. It can also be seen from FIG. 5 that signal FAST is generated by the logical NOR of signals U, $\overline{D}$ and B. As shown in FIG. 5, signal LOCK is generated by the logical NOR of signals FAST and SLOW.

Figure 6:
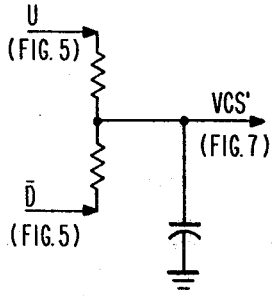
FIG. 6 discloses a Low Pass Filter circuit which may be employed, in accordance with the invention, in the Delay Regulator (FIG. 4).

FIG. 6 is a diagram of the low pass filter. The inputs U and $\overline{D}$ are added together and filtered to remove the carrier frequency. The output VCS' is a DC signal. The cutoff frequency of the low pass filter is designed to minimize the ripple on VCS' and at the same time maintain stability within the phase locked loop.

FIG. 11 is a reference generator. The voltage is generated by elements TA, TB, TC and TD. Element TE is used to drive signal Vref to the other circuits. The reference voltage ouput of this circuit is used as a logic threshold by the logic gates in FIG. 12 for the phase compare circuit in FIG. 5. This reference signal Vref is also used by the level shift circuit in FIG. 9. This voltage is used as a reference voltage for the logic signals.

FIG. 8 is the VCO circuit. It consists of N logic gates, which are individually shown in FIG. 10, connected in a loop configuration where gate 1 output goes to gate 2 input and this succeeds down through the line through gate N whose output is brought back to the input of gate 1. This circuit will oscillate at a frequency which is dependent upon the gate delay of the N elements. The actual gate delay of each element is controlled by signal VCS. It can be seen that the signal VCS changes the power in each gate. Each gate delay change results in a change of frequency of signal RLF. As the signal VCS is increased the RLF frequency will increase and as the VCS signal is decreased the RLF frequency will decrease. The output of this circuit RLF goes to the level shift circuit. Signal VR is the logic reference signal of the gates in this loop.

FIG. 9 is the level shift circuit. Its purpose is to change the logic level of the signal RLF to signals which are compatible with the off chip clock signal shown in FIG. 4. The signal RLF changes between voltage levels above signal VR and below signal VR. Elements TA, TB, TC and D comprise a logic gate switch configuration where the current through element TC goes through either element TA or element TB, depending on the input voltage RLF. The signal Vref which is derived from FIG. 11 is used for two functions. The first function is to generate a reference current for the current source elements TC and D. This reference current is created using elements G, TF and E and conveyed to the current source elements TC and D using a current mirror configuration, the connection between TF and TC. The second function of the Vref is clamping the output signal shifted VCO signal using diodes J and H so that the output signal is a diode drop above the Vref or a diode drop below the Vref. The operation of the circuit in FIG. 9 is controlled by the input signal RLF. When this input signal voltage is above the voltage VR, the current through element TC is directed through element TA. The current through element K goes through element J which produces a diode drop above signal Vref for the shifted VCO signal. When the signal RLF is below the voltage VR, the current through element TC goes through element TB pulling all of the current through element K through element TB and also pulling current from the signal Vref through element H. This produces a low level signal a diode drop below Vref, at the output for shifted VCO signal. It can be seen that the action of this circuit is to move the voltage reference of the logic input RLF to the reference of Vref. The output will be of the same frequency as RLF but of a different logic level.

FIG. 12 is a logic diagram of an internal gate used in the phase compare circuit of FIG. 5. The operation of this gate is similar to that of a current switch technology gate. The reference Vref is generated by the circuit in FIG. 11. The outputs are clamped levels either a diode drop above or a diode drop below the signal Vref. The circuit in FIG. 12 is shown with only two input transistors TA and TB, but other additional transistors may be connected in the same manner to provide a three or four input logic gate. A voltage at input 1 or input 2 which is above the input Vref will direct the current through that transistor and pull the output $\overline{\phi}$ a diode drop below Vref. The output $\phi$ will be a diode drop above Vref. If inputs 1 and 2 are both below Vref, the current will be directed through element TC and will pull the $\phi$ signal a diode drop below Vref. The $\overline{\phi}$ output will be a diode drop above Vref. The outputs in the circuit are diode clamped in order to provide the proper voltages to control the remaining part of the phase lock loop shown in FIG. 4.

FIG. 10 is a diagram of a typical logic gate to be used in both the VCO (FIG. 8) and also the logic gates on the rest of the chip as shown in FIG. 4. Elements TD and E form a current source which is controlled by a signal VCS. VCS, therefore, directly controls the power within the logic gate and thus, its speed. The logic gate is shown connected with two inputs, transistors TA and TB, but may also include additional transistors to be used as inputs connected in the same manner. The outputs $\overline{\phi}$ and $\phi$ are diode clamped to the VR signal such that the outputs are either a diode drop above or a diode drop below signal VR. The inputs 1 and 2 to the circuit are either above the signal VR or below the signal VR such that when either input 1 or input 2 is above VR the current from element TD is directed through that ON transistor. The output $\overline{\phi}$ then becomes a diode drop below VR. If neither 1 nor 2 is above the voltage VR, then the output $\overline{\phi}$ becomes a diode drop above VR. In the same manner, if both inputs 1 and 2 are below VR, the current from element TD is directed through element TC so that $\phi$ signal becomes a diode voltage drop below VR. If either inputs 1 or 2 are ON, then the output $\phi$ will be diode drop above VR. The signal VR goes to all the logic gates on the chip controlled by the delay regulator, including those logic gates composed in the VCO of FIG. 8 so that all these logic gates are using the same threshold voltage.

Figure 7:
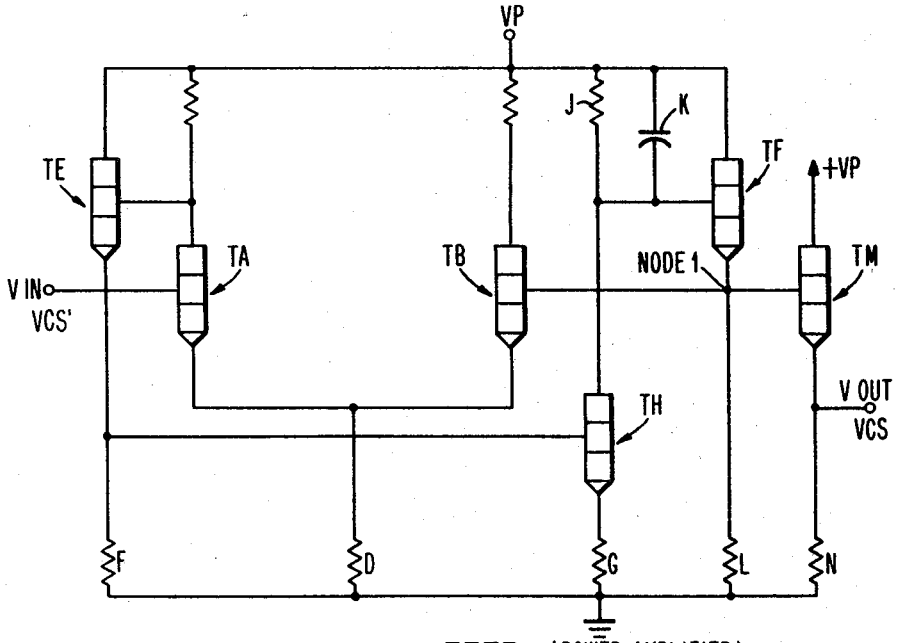
FIG. 7 discloses a Buffer Circuit which may be employed, in accordance with the invention, in the Delay Regulator (FIG. 4). It will be appreciated that the Buffer Circuit performs the function of, and may be termed, a power amplifier.

The circuit in FIG. 7 is a buffer circuit. It provides a high input impedance to the signal VCS' and provides a low output impedance drive for the VCS signal so that this signal may be driven over the entire chip to all logic gates as shown in FIG. 4. This circuit is a differential amplifier which has a gain of one. The elements TA, TB and D form the differential operation of the circuit. The input VCS' is compared to the signal at node 1 using the elements TA and TB and D. Elements TE, TF, G, TH, J and K provide the necessary signal conditioning so that the signal at node 1 is identical to input VCS'. Element TM and N provide additional output buffering and voltage translation to provide signal VCS which is provided to the logic gates and VCO (RLF) as shown in FIG. 4.

Figure 4A:
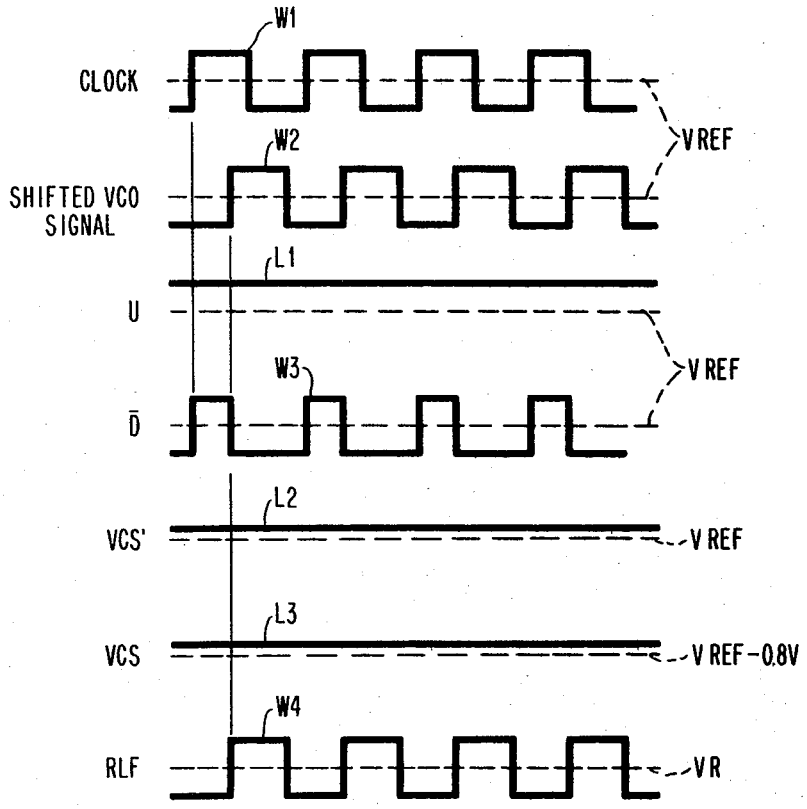
FIG. 4A shows idealized waveforms and potential levels to be viewed in conjunction with the explanation of the operation of the Delay Regulator (FIG. 4).

FIG. 4A discloses a number of waveforms and potential levels that are to be viewed in conjunction with the explanation of the operation of the delay regulator of FIG. 4. The inputs to the phase comparator of FIG. 4 are respectively waveform W1 (clock) and waveform W2 (shifted VCO signal). As seen from FIG. 4A, each of these waveforms has a portion of each pulse period which is above Vref and a lower level portion which is below Vref. Also apparent from waveforms W1 and W2 of FIG. 4A is that waveforms W1 and W2 each have the same periodicity or pulse repetition rate. However, clock waveform W1 leads in phase shifted VCO signal waveform W2. The output of the phase comparator U is a steady level represented by L1 in FIG. 4A. It will be noted that L1 has a magnitude greater than Vref. Further, it will be seen from FIG. 4A that output $\overline{D}$ is waveform W3. Waveform W3 is a periodic pulse train having a periodicity equal to that of waveform W1. Also, it will be seen that the duration of the pulses in waveform W3 are equal to or directly proportional to the phase difference between waveforms W1 and W2. As seen from FIG. 4A, signal VCS' is a steady state level L2. The magnitude L2 of signal VCS' is a function of the average potential of the signals U (L1) and $\overline{D}$ (waveform W3) and the duration of the pulses of waveform W3. As will be appreciated from the earlier explanation herein of the function of the buffer circuit (FIG. 7), VCS has a magnitude L3 which is a transistor VBE below the magnitude L2 of signal VCS'. Still referring to FIG. 4A, it will be seen that the magnitude L2 of signal VCS' is an increment, for example, $\Delta$ above the magnitude of Vref and the signal VCS which has been shifted by a DC magnitude of 0.8 of one volt is also a $\Delta$ above Vref-0.8 volt. Waveform W4 represents a periodic pulse train corresponding to the signal RLF of FIGS. 4 and 8. Also shown is the magnitude of VR. It will be seen from FIG. 4A that waveform W2 (shifted VCO signal) and waveform W4 (RLF) correspond one to another in periodicity and pulse duration. As seen from FIG. 4, waveform W4 (RLF) is shifted by level shifter circuit (FIG. 9) and becomes shifted VCO signal, the output of the Level Shift circuit of FIG. 4.

Figure 4B:
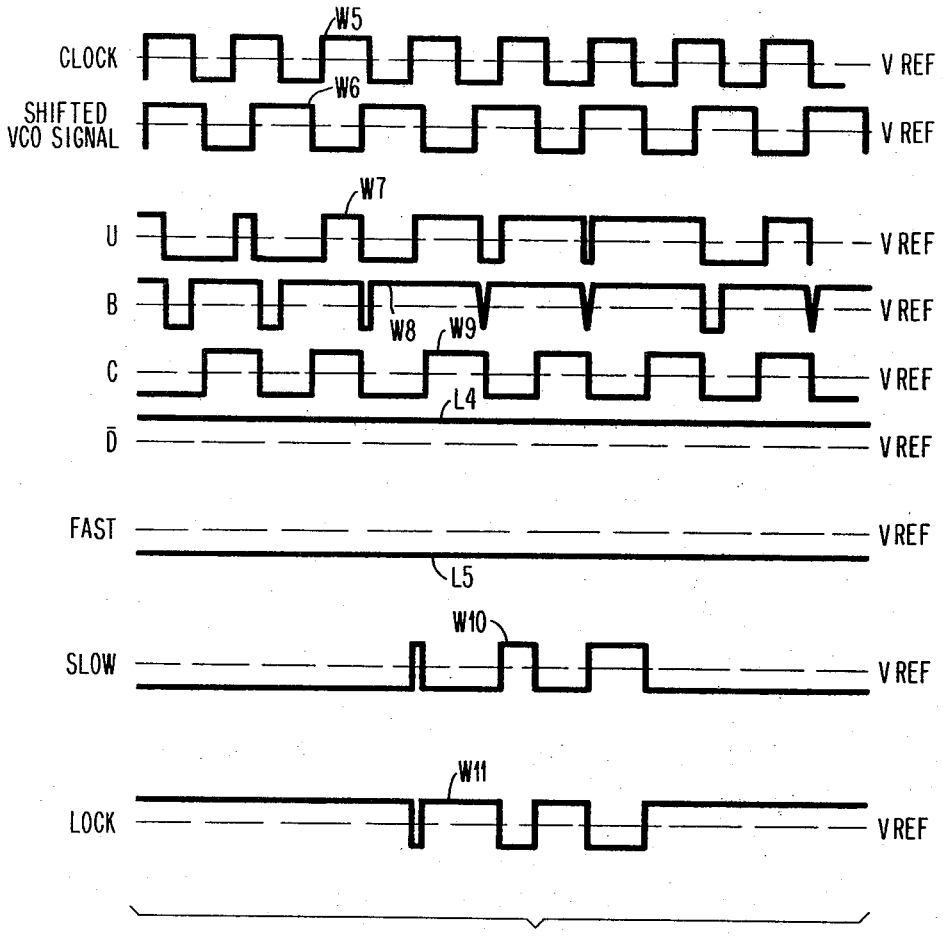
FIG. 4B shows idealized waveforms and levels to be viewed in conjunction with the explanation of the operation of $\phi$ compare and AC measuring circuit (FIG. 5) for an example of shifted VCO signal having a lower frequency than clock.
Figure 4C:
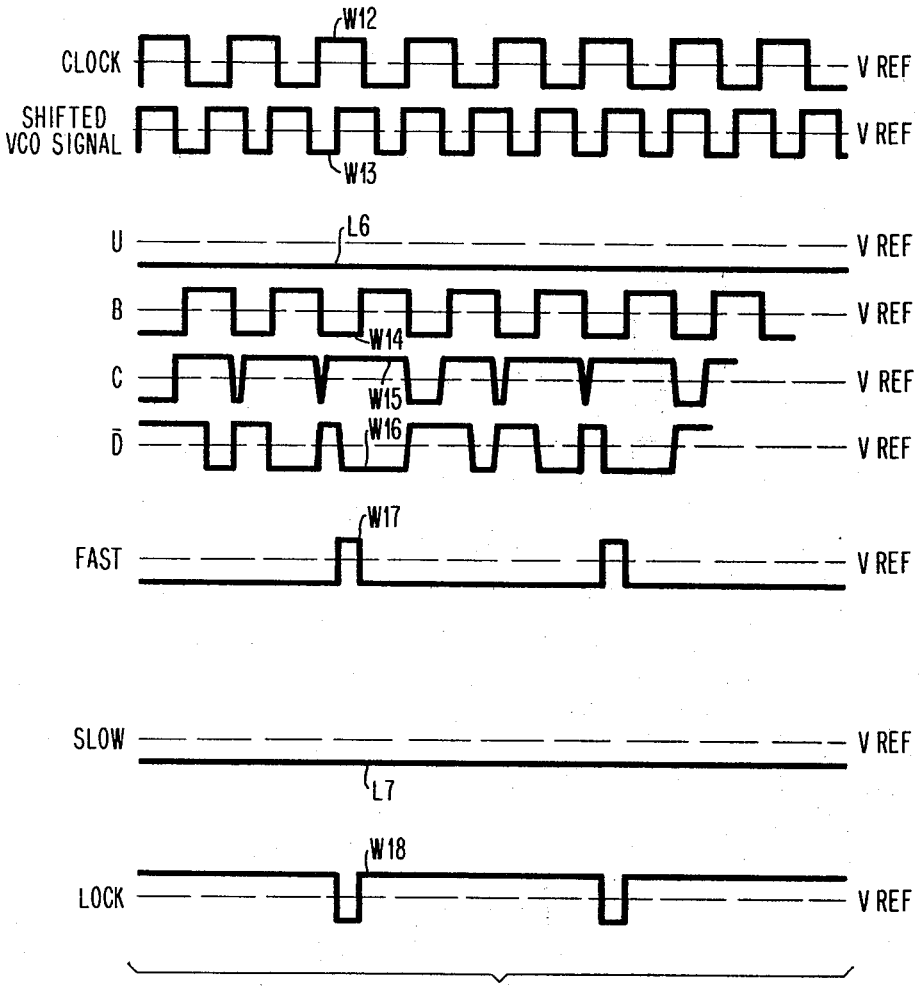
FIG. 4C shows idealized waveforms and levels to be viewed in conjunction with the explanation of the operation of $\phi$ compare and AC measuring circuit (FIG. 5) for an example of shifted VCO signal having a higher frequency than clock.
Figure 4D:
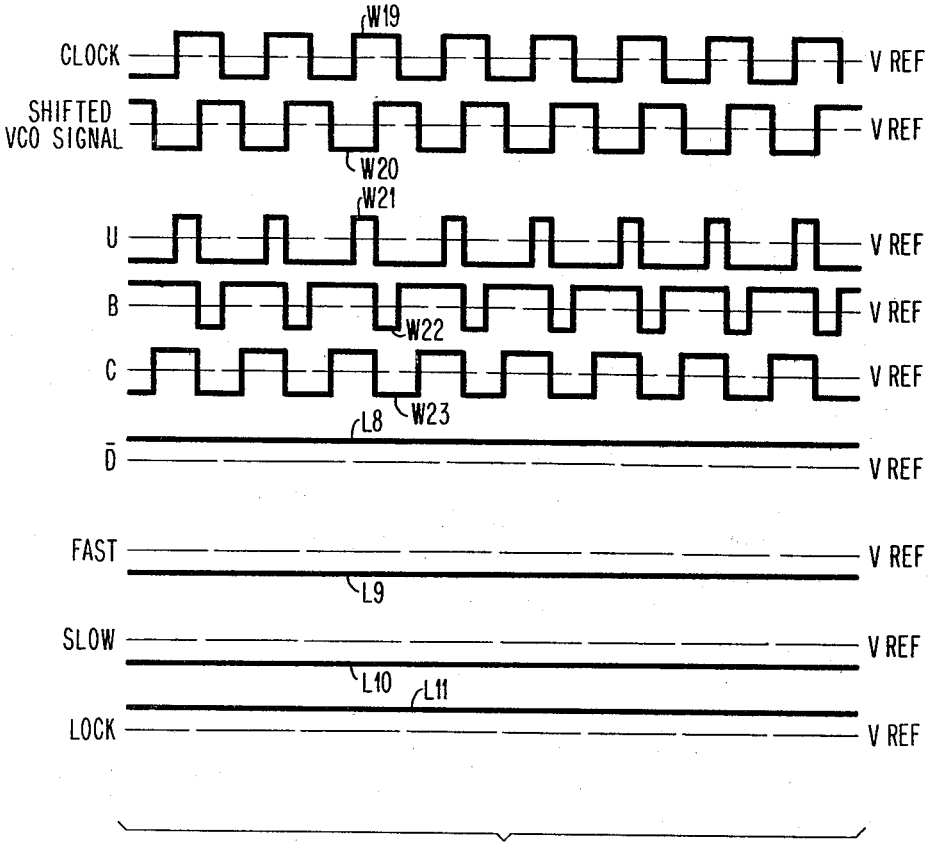
FIG. 4D shows idealized waveforms and levels to be viewed in conjunction with the explanation of the operation of $\phi$ compare and AC measuring circuit (FIG. 5) for an example of shifted VCO signal having the same frequency as clock.

FIGS. 4B, 4C and 4D disclose a number of waveforms and potential levels that are to be viewed in conjunction with the explanation of the operation of the phase compare and AC measurement circuit in FIG. 5. These three figures (4B, 4C and 4D) will demonstrate the waveforms and potential levels for the conditions of VCO frequency lower than clock frequency, VCO frequency higher than clock frequency and VCO locked onto clock frequency.

FIG. 4B discloses a number of waveforms and potential levels that are to be viewed in conjunction with the explanation of the operation of the phase compare and AC measurement circuits of FIG. 5 for the example of VCO frequency slower than clock. The inputs to the phase comparator of FIG. 5 are respectively waveform W5 (clock) and W6 (shifted VCO signal). As seen from FIG. 4B waveform W5 has a smaller periodicity than waveform W6, therefore, waveform W6 has a lower frequency than waveform W5. It will be seen from FIG. 4B that signal U is waveform W7. Waveform W7 is a periodic pulse train generated from waveforms W5 and W6. It is noted the transition from below VREF to above VREF of waveform W7 corresponds to transition from below VREF to above VREF of waveform W5. The transition from above VREF to below VREF of waveform W7 corresponds to the transition from below VREF to above VREF to waveform W6. It will be seen from FIG. 4B that signal B is waveform W8 and signal C is waveform W9. Waveforms W8 and W9 are generated from waveforms W5 and W6. Waveforms W8 and W9 have periodicities and pulse durations which depend on the logic levels and logic level changes of waveforms W5 and W6. It will be seen in FIG. 4B that signal $\overline{D}$ is a steady level represented by L4. It will be seen in FIG. 4B that signal FAST is a steady level represented by L5. It will also be seen in FIG. 4B that signal SLOW is represented by waveform W10 and signal LOCK is represented by waveform W11. As will be appreciated from the earlier explanation herein of the AC measurement circuit the level L5 corresponding to signal FAST is a result of the logical NOR of waveforms W7 and W8, and level L4. It will also be appreciated from the same explanation of the AC measurement circuit the waveform W10 corresponding to signal SLOW is a result of the logical NOR of waveform W9, the logical inverse of waveform W7, and logical inverse of level L4. It will also be appreciated from the same explanation of the AC measurement circuit the waveform W11 corresponding to signal LOCK is the result of the logical NOR of waveform W10 and level L5.

FIG. 4C discloses a number of waveforms and potential levels that are to be viewed in conjunction with the explanation of the operation of the phase compare and AC measurement circuits of FIG. 5 for the example of VCO frequency faster than clock. The inputs to the phase comparator of FIG. 5 are respectively waveform W12 (clock) and W13 (shifted VCO signal). As seen from FIG. 4C waveform W12 has a longer periodicity than waveform W13, therefore waveform W13 has a higher frequency than waveform W12. It will be seen from FIG. 4C that signal $\overline{D}$ is waveform W16. Waveform W16 is a periodic pulse train generated from waveforms W12 and W13. It is noted the transition from below VREF to above VREF of waveform W16 corresponds to transition from below VREF to above VREF of waveform W12. The transition from above VREF to below VREF of waveform W16 corresponds to the transition from below VREF to above VREF of waveform W13. It will be seen from FIG. 4C that signal B is waveform W14 and signal C is waveform W15. Waveforms W14 and W15 are generated from waveforms W12 and W13. Waveforms W14 and W15 have periodicities and pulse durations which depend on the logic levels and logic level changes of waveforms W12 and W13. It will be seen in FIG. 4C that signal U is a steady level represented by L6. It will be seen in FIG. 4C that signal FAST is a waveform represented by W17. It will also be seen in FIG. 4C that signal SLOW is represented by level L7 and signal LOCK is represented by waveform W18. As will be appreciated from the earlier explanation herein of the AC measurement circuit the waveform W17 corresponding to signal FAST is a result of the logical NOR of waveforms W16 and W14, and level L6. It will also be appreciated from the same explanation of the AC measurement circuit the level L7 corresponding to signal SLOW is a result of the logical NOR of waveform W15, the logical inverse of waveform W16, and logical inverse of level L6. It will also be appreciated from the same explanation of the AC measurement circuit the waveform W18 corresponding to signal LOCK is the result of the logical NOR of waveform W17 and level L7.

FIG. 4D discloses a number of waveforms and potential levels that are to be viewed in conjunction with the explanation of the operation of the phase compare and AC measurement circuits of FIG. 5 for the example of VCO frequency the same as clock frequency. The inputs to the phase comparator of FIG. 5 are respectively waveform W19 (clock) and W20 (shifted VCO signal). As seen from FIG. 4D waveform W19 has the same periodicity as waveform W20, therefore waveform W20 has the same frequency as waveform W19. It will be seen from FIG. 4D that signal U is waveform W21. Waveform W21 is a periodic pulse train generated from waveforms W19 and W20. It is noted the transition from below VREF to above VREF of waveform W21 corresponds to transition from below VREF to above VREF of waveform W19. The transition from above VREF to below VREF of waveform W21 corresponds to the transition from below VREF to above VREF of waveform W20. It will be seen from FIG. 4D that signal B is waveform W22 and signal C is waveform W23. Waveforms W22 and W23 are generated from waveforms W19 and W20. Waveforms W22 and W23 have periodicities and pulse durations which depend on the logic levels and logic level changes of waveforms W19 and W20. It will be seen in FIG. 4D that signal $\overline{D}$ is a steady level represented by L8. It will be seen in FIG. 4D that signal FAST is a steady level represented by L9. It will also be seen in FIG. 4D that signal SLOW is represented by level L10 and signal LOCK is represented by level L11. As will be appreciated from the earlier explanation herein of the AC measurement circuit the level L9 corresponding to signal FAST is a result of the logical NOR of waveforms W21 and W22 and level L8. It will also be appreciated from the same explanation of the AC measurement circuit the level L10 corresponding to signal SLOW is a result of the logical NOR of waveform W23, the logical inverse of waveform W21, and logical inverse of level L8. It will also be appreciated from the same explanation of the AC measurement circuit the level L11 corresponding to signal LOCK is the result of the logical NOR of level L10 and level L9.

As explained earlier herein, it is to be appreciated that the signal VCS (L3, FIG. 4A) is the output of the buffer of the delay regulator of FIG. 4. This magnitude or output VCS is utilized in accordance with the invention in determining the point on the gate delay versus power characteristics at which the logic circuits operate. Thus, this magnitude is determinative of the constant speed or gate delay of the logic circuits receiving the signal VCS.

FURTHER ILLUSTRATIVE EMBODIMENTS OF THE INVENTION

FIG. 13 shows the VCO circuit used in the TTL configuration. The input signal to the circuit, VCS, controls the power in each logic gate (FIG. 14). As explained previously, changing the power in the VCO logic gates results in a frequency change in signal RLF. Referring to FIG. 4, the implementation of TTL in this preferred embodiment may not require the level shift circuit (FIG. 9) to change the logic voltage levels of the signal RLF. If no level shift circuit is needed, as would be readily determined by one skilled in the art, the signal RLF (referring to FIG. 4) would replace the signal shifted VCO signal as the input to the $\phi$ compare circuit (FIG. 5). Also, signal VR and shifted VCO signal would be removed from the circuit since they are no longer required. However, if it is determined, by someone skilled in the art, that a level shift circuit is needed, the new level shift circuit may not require the signal VR to produce a signal shifted VCO signal compatible with the $\phi$ compare circuit. Persons skilled in the art will also note, using TTL or any other logic in the $\phi$ compare logic may require additional circuits in order for signals U and $\overline{D}$ (FIG. 4) to appear as proper source impedances, and/or voltage/current levels, and/or temperature/power supply corrections for proper delay regulation circuit (FIG. 4) operation.

FIG. 14 is an example of a TTL gate which may be used in the VCO circuit of FIG. 13. Other configurations of TTL, which are known in the art, may also be used. The signal VCS, produced by the buffer circuit, or power amplifier (FIG. 7), goes to all the logic gates in the VCO circuit (FIG. 13) and to the logic gates on the remaining portion of the chip (not shown) which may or may not include the $\phi$ compare circuit (FIG. 5). The control signal VCS varies the power in the logic gate (FIG. 14). As VCS is increased, power is increased to the logic gate resulting in a decrease in gate delay. In the same manner, as VCS is decreased, the power is decreased to the logic gate resulting in an increase in gate delay. It will be appreciated by those skilled in the art that the voltage level of signal VCS may be increased only to the voltage level where any further increase in voltage level no longer obtains a decrease in gate delay.

FIG. 15 shows the VCO circuit used in the $I^2L$ configuration. The input signal to the circuit, VCS for the logic gate in FIG. 16, or VCS" for the logic gate in FIG. 17, controls the power in each logic gate. As explained previously, changing the power of the VCO logic gates results in a frequency change in signal RLF. As discussed above in describing the use of TTL in the VCO circuit, the level shift circuit may or may not be needed, the signal (s) shifted VCO signal and/or VR may or may not be needed, and additional circuits for proper delay regulation circuit (FIG. 4) operation may or may not be needed.

FIGS. 16 and 17 are two examples of controlling the power to an $I^2L$ gate. FIG. 16 shows the current through element TA being controlled by a variable voltage VCS. The voltage VCC is fixed so that as the voltage of signal VCS is decreased, the power to the logic gate is increased, thereby decreasing the logic gate delay. In the same manner, as the voltage of signal VCS is increased, the power to the logic gate is decreased, which, in turn, increases the logic gae delay. It will be appreciated by those skilled in the art in order to obtain proper delay regulation circuit (FIG. 4) operation, the signals U and $\overline{D}$ produced by the $\phi$ compare circuit (FIG. 5) must be logically inverted ($\overline{U}$ and D).

FIG. 17 shows an $I^2L$ gate being controlled by a voltage variation over element B. The base connection of element TA is connected to "ground" so that as signal VCS varies, the current through element TA changes. AS the voltage of signal VCS increases, the power increases in the logic gate, therefore, the logic gate delay is decreased. In the same manner, as the voltage of signal VCS decreases, the power decreases in the logic gate, therefore, the gate delay increases. It should be appreciated that for this particular logic gate, VCS will not be distributed to the VCO and remaining logic gates on the chip. Instead, signal VCS" will be distributed to the VCO and remaining logic gates on the chip.

FIG. 18 shows a VCO circuit which may be used in an FET embodiment. The input signal, VCS, controls the power to each FET logic gate (FIG. 19). As previously explained, changing the power in the VCO gates results in a frequency change in signal RLF. Also, increasing the power to the FET logic gate (FIG. 19) reduces the delay and decreasing the power to the logic gate increases the delay.

In view of the aforegoing detailed explanation of applicants' preferred embodiment of the invention, it will be readily apparent to persons skilled in the art that a number of modifications to applicants' invention may be made without departing from the spirit and scope of applicants' invention.

For example, the following numbered paragraphs summarize a limited number of changes and modifications which may be made to applicants' invention without departing from the spirit and scope thereof.

1. Not necessary to use a phase locked loop. A frequency locked loop may be used.
2. System clock not necessary—may use a separate clock.
3. Inverters not necessarily the only type of gate which may be used for [(VCO) RLF] loop.
4. Frequency comparison may be made by two RC filters and a voltage comparison.
5. May have more than one regulator on a chip.
6. Buffer circuit, or power amplifier, may have a gain other than 1.
7. Low pass filter may be incorporated into the buffer circuit.

The concept of the invention may be summarized as set forth in the following paragraphs:

Any circuit exhibiting a speed-power relationship may have its speed adjusted, or regulated, in-situ by varying the power to it.

The means by which the power may be varied is accomplished by a feedback loop consisting essentially of an oscillator (built up from the circuit to be adjusted) signal, a reference signal (clock), a means for comparing the reference and oscillator signals and generating an "error" signal, and a means for converting the error signal into the appropriate control.

The oscillator may be constructed in any one of a number of ways familiar to those skilled in the art; for purposes of explanation, the use of a RLF VCO has been described. The reference signal has been referred to as a clock signal.

The comparator, which serves a function of frequency to either voltage or current conversion, may be any means available to those skilled in the art such as pulse width modulation, D flip flops, D to A converters to Phase Locked Loops. For purposes of explanation, the use of a Phase Comparator Phase Locked Loop has been expressly described in detail herein.

While the invention has been particularly shown and described with reference to a preferred embodiment thereof, it will be understood by those skilled in the art that the foregoing and other changes in form and detail may be made therein without departing from the spirit and scope of the invention.

What we claim is:

1. In an electronic system an integrated circuit chip, said integrated circuit chip including delay regulator means and at least first, second and third interconnected logic circuits, each said logic circuit on said chip having a speed/power characteristic, a source of periodic clock pulses, said delay regulator means of said integrated circuit chip being adapted to receive said periodic clock pulses, said delay regulator means including active circuit means for generating an electrical manifestation related to the periodicity of said periodic clock pulses and said speed power characteristic, and said delay regulator means including additional circuit means responsive to said electrical manifestation for rendering a first indication that said logic circuits on said chip are capable of operating at a speed faster than said periodicity of said periodic clock pulses or a second indication that said logic circuits on said chip are not capable of operating at a speed equal to or greater than said periodicity of said clock pulses.

2. In an electronic system, as recited in claim 1, wherein said delay regulator means comprises a phase-locked loop and said additional circuit means comprises logical circuit means.

3. In an electronic system, said system comprising:

one or more interconnected integrated circuit chips, each of said one or more integrated circuit chips having a plurality of interconnected logic circuits thereon, each of said logic circuits having a gate delay versus power curve;

power control means for regulating the power to each of said one or more chips whereby the power provided to said logic circuits on said one or more integrated circuit chips may vary chip to chip but said gate delay of said logic circuits on each of said one or more integrated circuit chips will be essentially equal one to another; and additional means for manifesting the relative gate delay of the interconnected logic circuits on each of the interconnected integrated circuit chips.

4. In an electronic system including one or more interconnected integrated circuit chips, as recited in claim 3, wherein said power control means comprises a discrete delay regulator means contained on each chip of said one or more interconnected integrated circuit chips, and said additional means comprises a discrete AC measurement means contained on each chip of said one or more interconnected integrated circuit chips.

5. In an electronic system including one or more interconnected integrated circuit chips, as recited in claim 4, wherein each of said discrete delay regulator means is adapted to receive a periodic clock pulse and generate an on chip periodic pulse, said generated on chip periodic pulse having a periodicity related to a point on said gate delay versus power curve of the logic circuits on the chip on which said generated on chip periodic pulse is generated and each of said discrete AC measurement means contained on each chip of said one or more interconnected integrated circuit chips comprises logical circuit means for indicating the relative gate delay of the interconnected logic circuits on each of said one or more interconnected integrated circuit chips by indicating for each of said chips the relative magnitude of the periodicity of the periodic clock pulse as compared to the on chip generated periodic pulse.

6. In an electronic system including one or more interconnected integrated circuit chips, as recited in claim 5, wherein each of said discrete delay regulator means compares said period clock pulse with its on chip generated periodic pulse and provides an electrical energy manifestation representative of the result of the comparison of said periodic pulses.

7. In an electronic system including one or more interconnected integrated circuit chips, as recited in claim 6, wherein each of said delay regulator means includes means for providing its electrical energy manifestation in the form of an electrical potential.

8. In an electronic system including one or more interconnected integrated circuit chips, as recited in claim 6, wherein each of said delay regulator means includes means for providing its electrical energy manifestation in the form of an electrical current.

9. In an electronic system, said system including:

N interconnected integrated circuit chips, where N is an integer positive number, each of said N interconnected integrated circuit chips containing a delay regulator means and at least first, second and third interconnect logic circuits, said logic circuits on each of said chips having a relatively unique speed/power characteristic;

a source of periodic clock pulses;

said delay regulator means of each of said N interconnected circuit chips being adapted to receive said period clock pulses, each of said delay regulator means including active circuit means for generating on chip periodic pulses related to said periodicity of said periodic clock pulses and said speed power characteristic of the logic circuits on the chip on which said delay regulator means is contained, said delay regulator means also providing an electrical manifestation related to said periodicity of said periodic clock pulses and the periodicity of said on chip generated periodic clock pulses;

connection means on each of said N interconnected integrated circuit chips, said connection means on each of said N interconnected integrated circuit chips conveying the electrical manifestation generated by the delay regulator means on said chip to said logic circuits on said same chip, whereby the power provided to said logic circuits on said chips is regulated and may vary chip to chip; and each of said N interconnected integrated circuit chips containing additional circuit means, said additional circuit means of each of said N interconnected integrated circuit chips cooperating with the delay regulator means of the chip on which both said delay regulator means and said additional means are contained, each said additional means providing (1) a LOCK signal when the periodicity of said on chip generated periodic pulses is equal to the periodicity of said periodic clock pulses; (2) a FAST signal when the periodicity of said on chip generated periodic pulses is less than the periodicity of said periodic clock pulses, and (3) a SLOW signal when the periodicity of said on chip generated periodic pulses is greater than the periodicity of said periodic clock pulses.

10. In an electronic system having N interconnected integrated circuit chips as recited in claim 9, wherein each of said delay regulator means comprises a phase-locked loop and each of said additional circuit means comprises an AC measurement circuit comprised of logical circuit means.

11. In an electronic system, as recited in claim 8, wherein each of said delay regulator means comprises:

a phase comparator circuit having first and second inputs and an output, said first input of said phase comparator circuit being adapted to receive means periodic clock pulses;

a low pass filter circuit having an input connected to said output of said phase comparator and an output;

a buffer circuit (or power amplifier) having an input connected to said output of said low pass filter circuit and an output;

a voltage controlled oscillator means having an input connected to said output of said buffer circuit and an output; and a level shift circuit having an input connected to said output of said voltage controlled oscillator and an input connected to said second input of said phase comparator circuit.

* * * * *

UNITED STATES PATENT AND TRADEMARK OFFICE

CERTIFICATE OF CORRECTION

PATENT NO. : 4,383,216

DATED : May 10, 1983

INVENTOR(S) : Jack A. Dorler, M. O. Jenkins, J. M. Mosley and S. D. Weitzel

It is certified that error appears in the above-identified patent and that said Letters Patent is hereby corrected as shown below:

| | |
|---|---|
| Column 17, lines 49 and 50 | "speed power" should read --speed/power. |
| Column 18, line 38 | "means" should read --said--. |

Signed and Sealed this

Twelfth Day of June 1984

[SEAL]

*Attest:*

*Attesting Officer*

GERALD J. MOSSINGHOFF

*Commissioner of Patents and Trademarks*